United States Patent [19]

Kroger

[11] Patent Number: 4,996,907

[45] Date of Patent: Mar. 5, 1991

[54] PNEUMATIC KNOCKING DEVICE

[75] Inventor: Dietrich Kroger, Wiesbaden, Fed. Rep. of Germany

[73] Assignee: Netter GmbH, Wiesbaden, Fed. Rep. of Germany

[21] Appl. No.: 352,351

[22] Filed: May 16, 1989

[30] Foreign Application Priority Data

Apr. 6, 1988 [DE] Fed. Rep. of Germany ..... 3819111

[51] Int. Cl.[5] ..... F15B 15/26

[52] U.S. Cl. ..... 91/433; 173/17/32

[58] Field of Search ..... 91/468, 433, 442; 173/17, 32, 119

[56] References Cited

U.S. PATENT DOCUMENTS

| | | | |
|---|---|---|---|
| 3,193,025 | 7/1965 | Aeitzel | 173/119 X |
| 3,610,349 | 10/1971 | Dempsey | 173/32 X |
| 4,333,537 | 6/1982 | Harris | 173/17 |

*Primary Examiner*—William E. Wayner

*Attorney, Agent, or Firm*—Paul & Paul

[57] ABSTRACT

A pneumatic knocking device comprising an elongate housing (1) in which a spring (9) and a top wall (20) with hole (10) are disposed, further comprising a cover (3) with connecting hole (8), a piston (2) movable towards the cover (3) by means of compressed air against the pressure of the spring (9), and a quick-acting vent valve (3, 8, 11, 15) which is disposed in the region of the cover (3) and which vents the chamber (22) beneath the piston (2) into the spring chamber (13) by means of an air conduit (14) is described and is characterized in that the air conduit (14) is in the form of an air passage which is integrated in the housing, that the top wall (20) is in one piece with the housing (1), the cover (3) forms a valve chamber (15) and is provided with a valve bore (21) in which a control diaphragm (11) is movably disposed in such a way that it can bear against the hole (10) in the top wall (20) and close same, and that the chamber (22) beneath the piston (2) is open outwardly.

8 Claims, 3 Drawing Sheets

PNEUMATIC KNOCKING DEVICE

Figure 1:
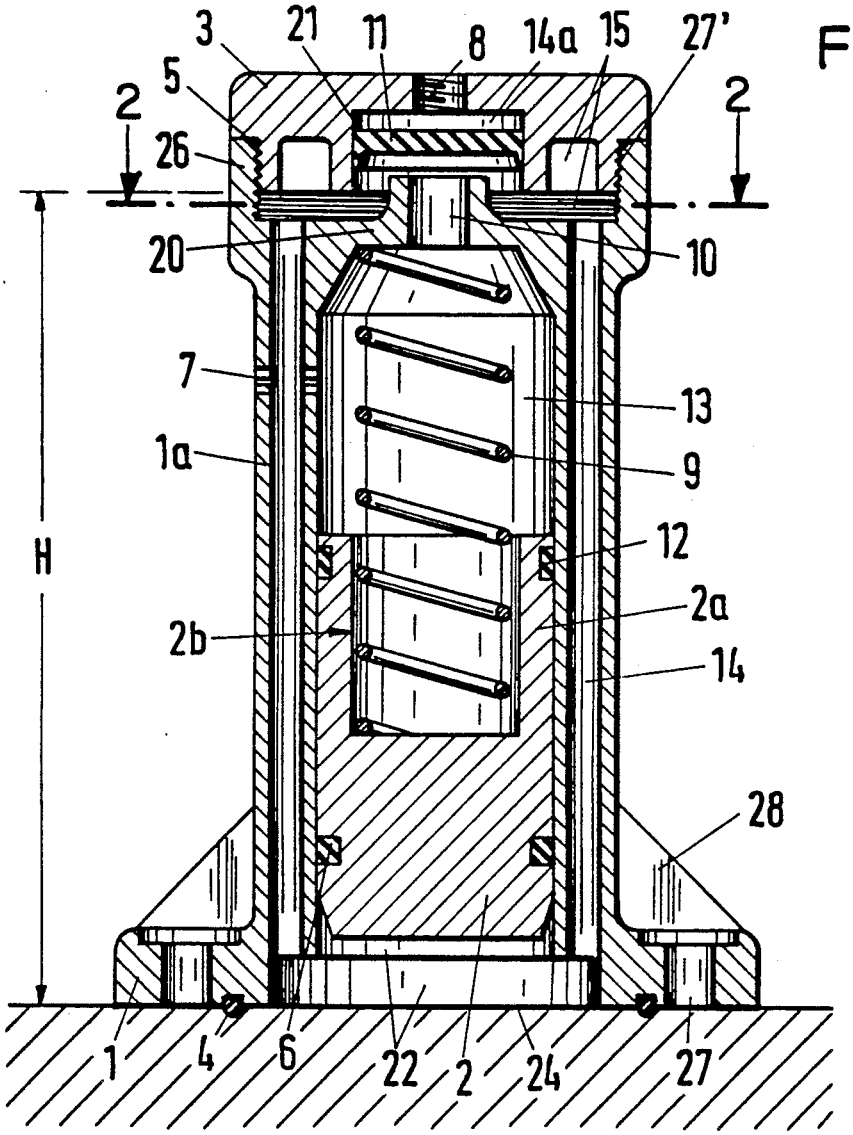

The invention relates to a pneumatically operable knocking device, in particular for knocking material in dust form off container walls, for example bunker walls, comprising a housing which encloses an elongate spring chamber having a vent bore, with spring, and which is closed at one end by a top wall with hole, a cover with connecting hole, a piston which is movable towards the cover by means of compressed air against the pressure of the spring, and a quick-acting vent valve which is disposed in the region of the cover and which vents the chamber beneath the piston into the spring chamber by means of an air duct.

Pneumatic knocking devices of the above-indicated kind are used to remove materials in dust form from the walls of silos or other storage containers when the stored materials are not entirely dry or have a tendency to form bridging configurations. A vigorous blow against the outside wall of the storage container can loosen the dust material, destroy the bridge configuration and cause the material to flow out.

Compressed air interval knocking devices which are available on the market at the present time comprise a cylinder tube which is closed with a striker plate at its bottom end towards the container and with a cover at its top end and in which the striker plate and the cover are of larger diameter than the outside diameter of the tube and are provided at the periphery with four bores through which anchor screws are fitted. Screwed on the cover of the knocking device is a reversing valve to which the compressed air supply conduit goes on the input side and from which a connecting nipple is branched off, on the output side. A connecting nipple is also fitted into the tube above the striker plate and a hose connects the two connecting nipples together. That arrangement suffers from the disadvantage that it requires a welded attachment sleeve and two hose nozzles as well as special sealing arrangements in order for that knocking device to be fitted in the appropriate fashion for operation thereof. It should also be noted that the sleeve is welded to the tube after it has been machined beforehand, for example milled at the rounded portion thereof. Any man skilled in the art is aware of the difficulties which arise in particular when the welding operation gives rise to distortion which has to be rectified.

Due to the large number and design configuration of the individual components, due to the large structural heights because of the reversing valve fitted thereon and because of the numerous connecting components required, endeavours were made to find less expensive constructions. In addition the lower striker plate caused dissipation of energy and had the effect of reducing efficiency for it first had to be accelerated by the piston.

It was also found that a considerable number of replacement parts had to be kept in stock because parts of the knocking devices suffered damage due to rust, leaks occurred at screw connections and anchor screw also broke off from time to time.

The known knocking device was also limited in regard to control for although an automatic cyclic control arrangement could be connected on the input side thereof, it was however not possible to control the knocking interval or the spaces between respective knocks or between respective groups of knocks, by using simple means, and certainly not at all in spaces which were safeguarded in regard to explosion. The level of expenditure on the actuating means is particularly high if pneumatic control arrangements are used as generally two timing relays are required, for the loading time and for the interval time.

Knocking devices are already available on the market in which the device is actuated by an internal reversing control, namely by a needle valve which is incorporated in the device, by way of bored control conduits, in a complicated construction. Due to the vibration in performing a knocking operation, the needle valves are easily taken out of adjustment. Regulation or re-adjustment is very expensive as the knocking devices are often mounted at an inaccessible location in the case of a bunker. In addition, there is the further disadvantage that it is not possible to provide for remote control, for example control in respect of the intervals, from a remote location.

The invention is therefore based on the problem of so improving a pneumatically operable knocking device of the kind set forth in the opening part of this specification that fewer and simpler components can be used for constructing same, without adversely affecting the flow conditions, while the control options can even be further increased.

In accordance with the invention that problem is solved in that the air duct is integrated in the housing in the form of at least one air passage extending approximately over the height of the housing, that the top wall is in one piece with the housing, the cover is disposed at a spacing from the top wall, leaving a valve chamber, and is provided with a valve bore which communicates with the connecting hole and in which a control diaphragm is movably disposed in such a way that it can bear against and close the hole in the top wall and that the chamber beneath the piston is open outwardly.

By virtue of the features according to the invention, the number of individual components for the pneumatic knocking device can be considerably reduced as for example anchor screws are no longer required with the novel design configuration. The striker plate described in the opening part of this specification, in the known device, is omitted because in accordance with the invention the chamber beneath the piston is open outwardly. In other words, the device eliminates the base plate as a holder for the anchor screws. That in turn makes it possible to provide sound-damping measures: if necessary it is possible to arrange a rubber plate or the like beneath the device so that instead of a metallic blow the device produces a damped blow (rubber hammer effect), as will be described in greater detail hereinafter.

The housing may be reduced in size by virtue of an integrated arrangement of the air passages and in particular by virtue of the configuration of the quick-acting vent valve between the cover disposed on the housing and the top wall of the housing. The abovedescribed, disadvantageous sealing arrangements and individual components such as weld sleeves, hose, hose nozzle and the like are advantageously also eliminated. The greater simplicity of assembly and the absence of components which are in danger of breaking, such as for example the anchor screws, means that the device no longer requires a comparatively large number of replacement parts so that the novel knocking device is considerably improved, with flow conditions which are at least of equal quality.

The portion of the housing of the knocking device, which is beneath the cover, is at the same time also the housing of the quick-acting vent valve. The positive influence thereof on the lower structural height of the novel knocking device will be apparent.

While hitherto smaller knocking devices could not be produced substantially less expensively than large pneumatic knocking devices, there was an insuperable construction limit in regard to the known knocking devices, solely by virtue of the diameter of the piston. The force required for driving the piston depends on the square of the diameter of the piston, with the structural height being equal. That limit can be shifted by virtue of the novel design configuration, also for the simple reason that the structural height can be less.

In that connection it is particularly advantageous in accordance with the invention for the housing to be a cast component. In that case all parts of the housing can also be produced economically in large numbers. A particularly preferred material is for example aluminium or plastics material. Highly advantageous manufacturing methods use permanent-mould or chill casting, or die casting. It will be appreciated that in that way rusting of such a housing with its individual ducts and passages is advantageously substantially eliminated.

While in the known knocking devices vent bores were arranged axially in the closure plate at the cover end, and opened into the surrounding air, beside the reversing valve fitted to the device, it was found in connection with the novel configuration of the knocking device according to the invention that there is no longer any space due to the novel integrated incorporation of the quick-acting vent valve, at the cover end. In order nonetheless to provide an arrangement corresponding thereto simply and effectively, it is proposed in accordance with the invention that the vent bore is arranged in the side wall of the housing, in radially extending configuration, in the third of the height of the housing, which is towards the cover.

The reference to the 'third of the height of the housing which is towards the cover' means that third of the height which is closest to the cover. The second third is then in the middle region of the housing while the last third is at the open end of the chamber beneath the piston. The knocking device according to the invention can be secured to the wall of a storage container in any desired position so that it is difficult to speak of 'up' or 'down'. Nonetheless the cover is to be interpreted as being arranged 'upwardly', in accordance with the present invention. That is not a limitation on the function or the position of installation of the knocking device according to the invention. The elongate chamber in which the piston is reciprocated may be of a polygonal, oval or polyhedral cross-section with rounded corners, but preferably that chamber is cylindrical for cylindrical pistons can be more easily produced, as experience has shown. Then, disposed in the one and a half thirds of that chamber, which are towards the cover, is what is known as the spring chamber which accommodates the compression or pressure spring, while disposed in the lower third of that chamber in the housing is the above-described 'chamber beneath the piston'. In that connection it will be appreciated that, upon actuation of the knocking device, the chamber beneath the piston can be completely filled by the latter.

It is at any event advantageous in regard to the function of the knocking device according to the invention if the vent bore is arranged in the upper third of the height of the housing, beside the cover, passing radially through the side wall. That vent bore is at least then open or provides a communication between the spring chamber and the surrounding atmosphere when the piston is in its lower position when the knocking device is unloaded, that is to say the compression spring is subjected to minimum compression.

In regard to the control configuration, it is particularly advantageous if in accordance with the invention a control bore is arranged in the wall of the housing, extending radially therein, in the third of the height of the housing which is towards the open end, and if there is provided a piston bore extending through the side wall of the hollow portion of the piston, and if the control bore communicates by way of a control conduit with a three/two-way air valve in the compressed air feed conduit. After a striking operation by the knocking device and in the final condition of the piston which is at the bottom in the device, the control bore in the lower region of the housing and the bore in the piston are disposed approximately at the same level.

In contrast to oscillating piston vibrators, the knocking device according to the invention produces individual blows at adjustable intervals. The device has the advantage that forceful blows can be produced, with a low level of consumption of air. If now the above-mentioned features are employed, the knocking device according to the invention permits remote control in a simple, inexpensive and operationally reliable fashion. More specifically, by virtue of the above-mentioned lower control bore in the housing of the knocking device, regulation for triggering off a knocking blow can be effected when the piston is in a position just before the final position which is reached in the loading phase. In that case the control bore is free, beneath the piston and outside same, and the air pressure obtaining beneath the piston actuates the three/two-way air valve so as to vent the connecting hole and thus trigger off the striking action of the knocking device. The mere fact of providing that control bore and also preferably the provision of the bore in the piston provides, without linkage, and without electrical drive means, fields or the like, that the knocking device has an adjustment capability such that the device operates at intervals, and it is only necessary to cut off the supply of compressed air, by way of an inexpensive control arrangement which is possibly arranged at a remote location in the compressed air feed conduit, and the knocking device immediately stops operating.

The configuration of the knocking device according to the invention is particularly simple if the control conduit and the 3/2-way valve are integrated in the housing. A housing with a plurality of passages can be easily produced when using die casting or permanent-mould or chill casting so that some passages can be used for the above-mentioned air conduit and a special bore serves as the control conduit.

The interval control arrangement, in accordance with the invention, can also be used inexpensively and without risk in areas which are safeguarded in respect of explosion. It is only necessary to install between the air supply connection and a throttle, a valve for the feed of compressed air in order to cause the striking intervals to be begun or concluded. As there are throttles which are very inexpensive but which can be accurately adjusted, it is also possible to provide for really accurate adjustment of the time for lifting the piston in the loading operation, by regulating the throttle. The piston speed in the direction of the spring and thus the striking interval can thus be regulated by means of the throttle.

The above-described control arrangement is considerably improved in comparison with the known knocking devices. The novel mode of actuation, which can be achieved at low cost, is particularly of great advantage when only one actuating device is to be actuated at any one time.

When using the commercially available working time interval control configuration which actuates a valve disposed between the air supply connection and the throttle, the autocontrol function can also be used to cause the knocking device to strike a plurality of times during a time cycle which otherwise triggers off only one knocking blow. Very modest means are therefore adequate for that purpose, while in the previously known knocking devices a very high level of expenditure was required to provide a control action of that kind.

The strength of the knocking blows can also be regulated by means of pressure regulators in the compressed air feed conduit.

Reference has already been made hereinbefore to the possibility of sound damping, namely by disposing a rubber plate or the like beneath the device. Although knocking devices produce their optimum effect without a sound-damping plate, that does however give rise to a loud knocking noise, as in the case of a steel hammer. It may be preferred from time to time to provide for sound damping of the pneumatic knocking device, in which case although the effect thereof is slightly weaker, the knocking blow is sound-damped as when using a rubber hammer.

It has now been found however that, in the case of the knocking device, a rubber plate cannot be simply disposed beneath same in just any fashion, but that particular precautions have to be taken if the knocking device is to operate in the desired manner and produce the desired effect. It is therefore desirable if, in a further embodiment of the invention, the chamber beneath the piston is enlarged at the open end, while in particular the enlarged portion may be of a larger diameter than the other portion of the chamber, which is remote from the open end. The side walls of the housing embrace the piston, as described above. The portion, remote from the open end, of the chamber beneath the piston which has been explained and interpreted hereinbefore, is therefore determined by the diameter of the piston with a piston which is of round cross-section. In accordance with the invention it is now provided at this point that the chamber which is determined by the diameter of the piston is to be interpreted as an 'upper' chamber portion which terminates at a spacing from or 'above' the lowermost mounting surface, and is enlarged along the remaining part of said spacing to the mounting surface. If the two chamber portions are of circular configuration in plan view, then the enlargement can be provided by the enlarged portion being of larger diameter than the upper chamber portion. More specifically, the provision of an enlarged chamber beneath the piston affords the advantage that a sound-damping elastomer plate can be inserted in such a way that its lowermost or outermost surface lies flush with the mounting surface of the housing. Without an enlarged chamber portion of that kind, if a rubber plate were to be improperly arranged in position, that may give rise to the disadvantage that the rubber plate may suffer an increase in temperature to such an extent as to cause damage to the plate, if not destruction thereof, as a result of the energy which takes effect in the arrangement.

It is therefore particularly advantageous for at least one elastomer plate to be arranged in the enlarged portion of the chamber beneath the piston. The invention provides the teaching of disposing an elastomer plate not in just any fashion but in the enlarged chamber portion, with the result that the knocking blow is sound-damped, while the effect of the novel knocking device is still adequate.

It has also been found to be advantageous for the elastomer plate which naturally cannot be thicker than the chamber portion in which it is to be disposed to comprise a plurality of layers which as far as possible are even inserted separately. More specifically, it has been advantageously found that such elastomer plates afford a larger cooling area for air passing thereover, so that the abovementioned heating effect in regard to the elastomer plate can be restricted or eliminated by virtue of using a multi-plate construction.

Even in the case of those knocking devices which are to produce sound-damped knocking blows, by a suitably high input of energy, it is possible to fit one or more elastomer plates with a long service life if in accordance with the invention an opening is provided in the elastomer plate. By virtue of that arrangement, air in the chamber beneath the piston can find an exit flow passage so that any build-up of heat can be avoided. For example such an opening can be produced by boring or drilling; in that connection however the only important consideration is the capability of air to pass through the elastomer plate or plates. The elastomer plate can therefore be apertured, perforated, slitted or porous.

It has been found in operation that the elastomer plate floats in the flow of air in the chamber portion towards the open end of the device. More specifically, in the loading operation, the air (or other gases) which are introduced beneath the piston through the air conduit also pass in part beneath the elastomer plate and lift it towards the piston in the chamber portion which is towards the open end of the device. Conversely, when the device is performing its striking action, the elastomer plate is urged downwardly against the outermost mounting surface. That movement is the floating movement in the flow of air. It will be seen that in that way the freely floating plate is cooled in one phase from one side and in the other phase from the other side, and in addition through the opening or the edge surfaces.

Figure 2:
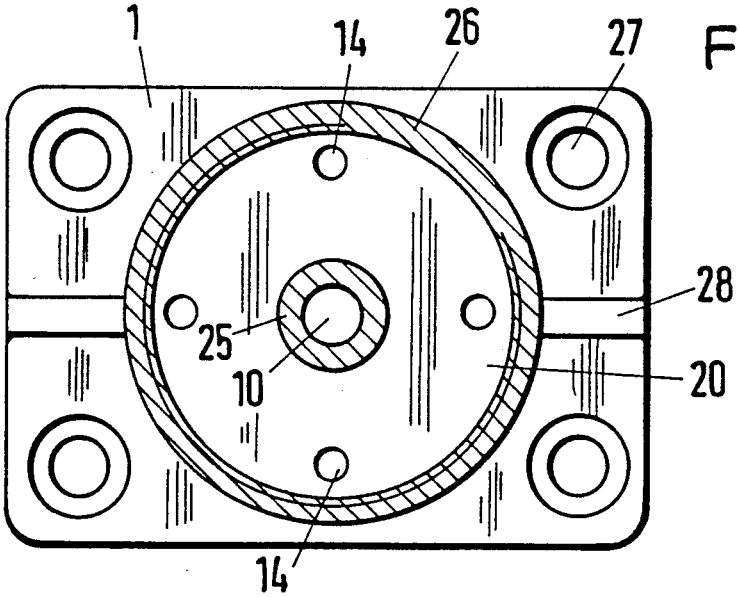
Figure 3:
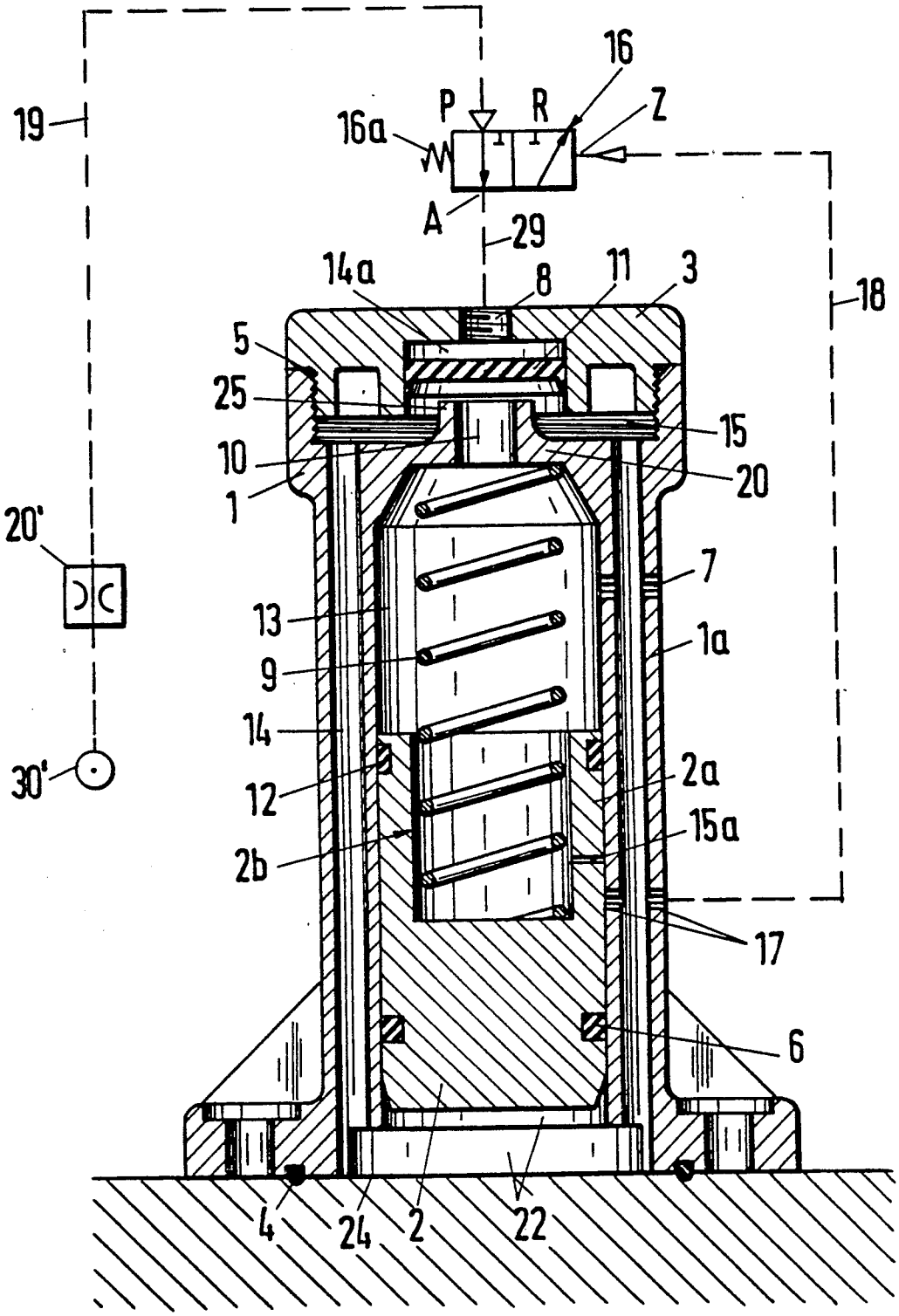
Figure 4:
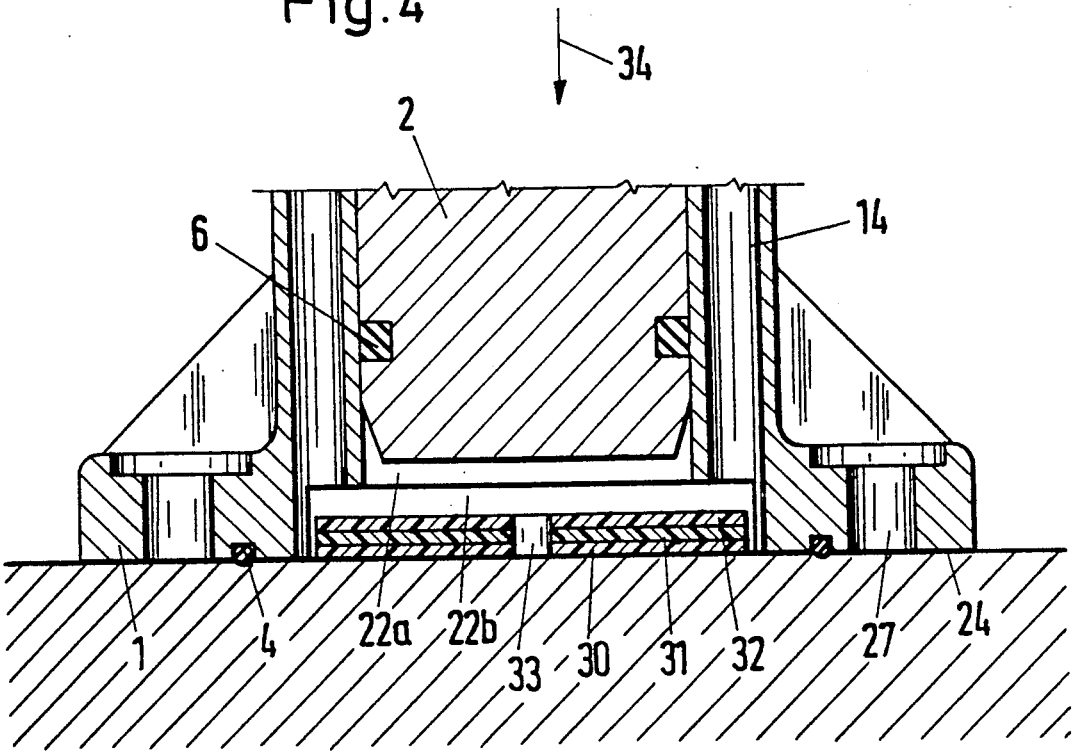

Further advantages, features and possible uses of the present invention will be apparent from the following description of preferred embodiments in conjunction with the drawings in which:

FIG. 1 is a view in vertical longitudinal section through a knocking device according to the invention, FIG. 2 is a view in section taken along line A-B in FIG. 1, FIG. 3 is a similar section to that shown in FIG. 1 but illustrating another embodiment of a knocking device with compressed air feed and control conduit, and FIG. 4 is a broken-away view of the lower portion of the knocking device, corresonding to the views shown in FIGS. 1 and 3, with the chamber beneath the piston being divided into two portions and with three thin elastomer plates with an opening being disposed in the enlarged portion.

In the embodiments of knocking devices as illustrated in the drawings, reference numeral 1 denotes a housing in which a piston 2 can be reciprocated in a cylindrical chamber against the force of a compression spring 9 and also in the reverse direction when the spring 9 is relieved of stress. In the views illustrated in FIGS. 1 and 3 the piston 2 is disposed just in a condition shortly before it strikes against the surface 24 at the bottom end thereof or after it has moved away from the surface 24 again in an upward stroke movement. Reference numeral 22 therefore identifies the space or chamber beneath the piston while reference numeral 13 identifies the spring chamber, that is to say that chamber in which the compression spring 9 is arranged. The compression spring 9 is disposed in the hollow portion 2*b* of the piston 2 within the side walls 2*a* and bears against the solid portion of the piston 2 at one end while at the other end it bears against the top wall 20 of the housing 1, in which there is provided a hole 10 which is surrounded in an upward direction by a cylindrical shoulder 25.

The substantially cylindrical side walls 1*a* of the housing 1 terminate in an upward direction in a collar portion 26 which is somewhat enlarged and which is provided with an internal screwthread 27'. The cover 3 is screwed into the screwthread 27, leaving a valve space or chamber 15. The cover may also be secured in position by radial screws.

Referring to FIG. 2, in section taken along line A-B in FIG. 1, shown therein is the circular collar portion 26 with which the shoulder 25 with the hole 10 is disposed in coaxial and concentric relationship. The valve chamber 15 can be seen between the shoulder 25 and the collar portion 26, above the top wall of the housing, which is visible therein. Four air passages 14 which are uniformly spaced around the periphery of the circle open in the top wall 20, the passages 14 extending from the chamber 22 beneath the piston 2 almost over the entire height H of the housing 1, into the valve chamber 15. As shown in FIG. 2, the housing 1 is enlarged downwardly in a generally rectangular configuration, and has four screw holes 27 by way of which the housing 1 can be screwed to a mounting surface 24 of a storage container, with the interposition of the seal 4.

A seal 5 is also provided at the cover end of the housing, while similarly a seal 6 is provided at the lower end of the piston 2, which is towards the open end of the housing, and a guide ring 12 is arranged in opposite relationship thereto at the hollow portion 2*b* of the piston 2, which is towards the cover. The ribs 28 only serve to stiffen the housing.

FIGS. 1 and 3 show the vent bores 7 which are arranged in the upper third (towards the cover) of the height H of the housing 1, passing radially through the side wall 1*a*, in such a way as to provide a communication between the spring chamber 13 and, when the control diaphragm is lifted off, also the air passages 14, and the outside air. In that arrangement the diameter of the vent bore 7 is considerably smaller than that of the air passages 14.

Disposed in the cover 3 in alignment with the hole 10 and in coaxial relationship is a valve bore 21 which accommodates a control diaphragm 11 of rubber, plastics material or another elastomer, wherein the control diaphragm 11 can slide axially upwardly and downwardly. The control diaphragm 11 may be urged downwardly to such an extent that it bears against the annular end face of the shoulder 25 and seals off the hole 10 when a suitable pressure obtains. Provided centrally in the cover and in coaxial relationship with the hole 10 and the valve bore 21 is the connecting hole 8 to which the conduit 29 is connected in a manner which is only diagrammatically shown in FIG. 3. The conduit 29 provides the communication between the connecting hole 8 and a 3/2-way valve 16. The valve 16 is in turn disposed in the conduit between the connecting hole 8 and the compressed air feed conduit 19. A throttle 20' and an air supply connection 30 are also disposed in the conduit 19, as shown in FIG. 3.

The control diaphragm 11 practically closes off the valve chamber 15 to a greater or lesser degree relative to the space or chamber 14*a* above the diaphragm 11. When there is a suitable pressure difference between the two chambers 14*a* and 15, air can flow past the edges of the control diaphragm 11. That is desirable, as will be described hereinafter in relation to operation of the arrangement.

The reference numerals and components required for the following description of operation of the embodiment of the knocking device shown in FIGS. 1 and 2 have been described.

The embodiment of the knocking device shown in FIG. 3, besides the above-described conduits 29, 18 and 19, also comprises the valve spring 16*a* and in particular the control bore 17 to which the control conduit 18 is connected by screw means.

The mode of operation of the knocking device in the embodiment shown in FIGS. 1 and 2 will now be described.

Compressed air passes by way of the connecting hole 8 to the flexible control diaphragm 11 which is thereby urged towards the hole 10 to the spring chamber 13 and is urged against the annular end face of the shoulder 25, closing off the spring chamber 13 relative to the valve chamber 15. As the spring chamber 13 communicates with the surrounding atmosphere or outside air by way of the vent bore 7, the pressure on the control diaphragm 11 from the actuated side thereof (from above) is greater than the pressure (from below) through the hole 10. The resulting pressure difference causes the control diaphragm 11 to be pressed against the shoulder 25 and thus causes the hole 10 to be closed off. The incoming compressed air flows past the flexible outside edge of the control diaphragm 11, and by way of the passages 14 which are provided in the housing 1 and which are for example formed by drilling or by being cast therein, to beneath the piston 2 and presses same against the compression spring 9.

When the three/two-way valve which is used for actuating the knocking device and which is illustrated only in relation to the embodiment of FIG. 3 is closed, that is to say, is displaced towards the left from the position shown in FIG. 3 against the force of the spring 16*a*, the connecting hole 8 for the compressed air is vented. The chamber 14*a* above the control diaphragm 11 is now communicated with the outside air. As a result of that, the pressure beneath the diaphragm 11 becomes stronger and lifts it. The compressed air beneath the piston 2 can now escape in a burst through the air passages 14 into the spring chamber 13 and from there into the outside air by way of the vent bore 7. The spring 9 can now shoot the piston 2 against the mounting surface 24. That causes shock acceleration of the mass, for example the wall, on which the knocking device is disposed.

The above-described mode of operation of the knocking device in the embodiment shown in FIGS. 1 and 2 equally applies in regard to the embodiment shown in FIG. 3 except that in that case there is additionally provided an auto control or regulation effect. The three/two-way air valve 16 is arranged in the vicinity of or at any distance from the knocking device, between the conduits 29 and 19, in such a way that its air outlet A is connected to the connecting hole 8 for compressed air. The valve 16 is open in an unactuated condition in the illustrated position, that is to say the air outlet A is connected to P and the knocking device is loaded as soon as the air supply connection 30' can supply air.

The compressed air feed conduit 19 can be put under operating pressure by a control arrangement (not shown), for example by means of a globe valve which can be arranged between the air supply connection 30' and the adjustable throttle 20'.

Just before the piston 2 is in the end position which is the upper position or the position towards the cover, which is reached in the loading operation, the control bore 17 is then beneath the position that the seal 6 has then reached. In that way a communication is made by way of the control conduit 18 between the chamber 22 beneath the piston 2 and the control connection Z of the valve 16.

The valve 16 moves towards the left against the force of the spring 16*a* from the position shown in FIG. 3 so that the valve closes the passage from P to A and opens the communication from A to R. In that way the knocking device is actuated for the connecting hole 8 is in fact vented.

After the knocking blow has been produced, that is to say when the force of the spring 9 has moved the piston 2 downwardly, a piston bore 15*a* which extends radially through the side wall 2*a* of the hollow portion 2*b* of the piston 2 passes into the region of the control bore 17. In that way the valve 16 can be vented by way of the control conduit 18, through the spring chamber 13 and the vent bore 7. The spring 16*a* now returns the valve 16 to the FIG. 3 position again. The cycle can then begin afresh.

The throttle 20' arranged in the compressed air feed conduit 19 between the air supply connection 30' and the valve 16 regulates the piston speed and therewith also the interval between knocking blows.

It will be appreciated that the control conduit 18 which in FIG. 3 is diagrammatically shown as extending outside the housing 1 may also be provided in the shell of the housing. For example, one of the four air passages 14 could be suitably connected. The quick-acting vent valve is in any case integrated in the cover 3 and the end of the housing 1 which is towards the cover.

The novel knocking device may also be manufactured with small outside dimensions so that it can also be used in relation to containers of smaller size. For example bakeries from time to time require smaller knocking devices of that kind, in regard to which it is also desirable that the container is almost entirely emptied of material therein, for example flour or baking powder, more specifically, when, after the container has been emptied, another material is to be introduced thereinto to fill same, the knocking device according to the invention can then be set in such a way that, for emptying the remaining material from the container, it simultaneously produces its knocking effect five times during the container emptying operation, with no other control arrangement than a throttle. The opening cylinder unit and the knocking device could be supplied by way of the same valve.

When reference is made herein to compressed air as the drive medium, it will be appreciated that that can also mean other gases under pressure.

FIG. 4 is a broken-away view of the lower portion of the knocking device shown in FIG. 1, which more clearly shows the division of the chamber 22 beneath the piston 2. If the mounting face 24 is again taken as being the downward face, then disposed at that location is the open end of the housing, as far as which the piston 2 can be moved in its striking operation. The chamber 22 is divided into two chamber portions, namely the enlarged portion 22*b* which is towards the open end of the housing, and the narrower portion 22*a* which is remote from the enlarged portion 22*b* and the diameter of which approximately corresponds to the diameter of the piston, in the situation where the chambers and also the chamber portions 22*a* and 22*b* are of circular cross-section. If the chambers are rectangular, then the dimensions of the rectangular configurations are then correspondingly adapted, and so forth.

The manufacturer supplies the knocking device possibly with loosely accompanying elastomer plates 30, 31 and 32. The purchaser will then insert into the enlarged portion 22*b* the number of plates that he wants. The knocking device can possibly also be operated without elastomer plates. The overall thickness of the inserted elastomer plates. 31–32 is smaller than the height (as considered in the axial direction of the housing 1) of the enlarged portion 22*b* of that chamber. When the elastomer plates 30–32 are circular discs, the diameter thereof is also smaller than the diameter of the enlarged chamber portion 22*b* so that the elastomer plates 30–32 can float freely, namely axially and radially, in the air flow in the enlarged chamber portion 22*b*.

In addition all three elastomer plates 30–32 are provided with openings 33 which are arranged in alignment with each other and which in this case are provided at the centre of the plates.

In operation of the device, in the loading operation, air or another gas flows downwardly through the air passage 14 and also from the outside beside the elastomer plates 30–32 so that they are partially lifted. The air then flows from the side, over, between and beneath the plates, into the inner portion 22*a* of the chamber 22 beneath the piston 2 and in part also through the opening 33 so that the loading operation can be effectively carried out in the manner described.

After the striking operation is triggered off, the piston 2 is urged downwardly in the direction indicated by the arrow 34 by the force of the spring 9. It drives the air out of the chamber portions 22*a* and 22*b* through the opening 33 on the one hand and at the edges of the elastomer plates 30–32 on the other hand, by way of the air passage 14, and finally strikes against the elastomer plates (with a dampened blow).

I claim:

1. A pneumatically operable knocking device, in particular for knocking material in dust form off container walls, for example bunker walls, comprising a housing (1) which encloses an elongate spring chamber (13) having a vent bore (7), with spring (9), and which is closed at one end by a top wall (20) with hole (10), a cover (3) with connecting hole (8), a piston (2) which is movable towards the cover (3) by means of compressed air against the pressure of the spring (9), and a quick-acting vent valve (3, 8, 10, 11, 14*a*, 15) which is disposed in the region of the cover (3) and which vents the chamber (22) beneath the piston (2) into the spring chamber (13) by means of an air duct (14) characterised in that the air duct (14) is integrated in the housing (1) in the form of at least one air passage extending approximately over the height (H) of the housing (1), that the top wall (20) is in one piece with the housing (1), the cover (3) is disposed at a spacing from the top wall (20), leaving a valve chamber (15), and is provided with a valve bore (21) which communicates with the connecting hole (8) and in which a control diaphragm (11) is movably disposed in such a way that it can bear against and close the hole (10) in the top wall (20) and that the chamber (22) beneath the piston (2) is open outwardly.

2. A knocking device according to claim 1 characterised in that the housing (1) is a cast component.

3. A knocking device according to claim 1 or claim 2 characterised in that the vent bore (7) is disposed in the side wall (1*a*) of the housing in radially extending relationship in the third, which is towards the cover, of the height (H) of the housing (1).

4. A knocking device according to one of claims 1 or 2 characterised in that a control bore (17) is arranged in radially extending relationship in the side wall (1*a*) of the housing in the third, which is towards the open end, of the height (H) of the housing (1), that there is provided a piston bore (15*a*), passing through the side wall (2*a*) of the hollow portion (2*b*) of the piston (2), and that the control bore (17) is communicated by way of a control conduit (18) with a three/two-way air valve (16) in the compressed air feed conduit (19).

5. A knocking device according to claim 4 characterised in that the control conduit (18) and the three/two-way valve (16) are disposed in integrated relationship in the housing (1).

6. A knocking device according to one of claims 1 or 2 characterised in that the chamber (22) beneath the piston (2) is enlarged at the open end (in the portion 22*b*), wherein in particular the enlarged portion (22*b*) is of larger diameter than the other portion (22*a*) of said chamber, which is remote from the open end.

7. A knocking device according to claim 6 characterised in that at least one elastomer plate (30, 31, 32) is arranged in the enlarged portion (22*b*) of the chamber (22) beneath the piston (2) (FIG. 4).

8. A knocking device according to claim 7 characterised in that an opening (33) is provided in the elastomer plate (30–32) (FIG. 4).

* * * * *